US008047817B2

(12) United States Patent
Manson et al.

(10) Patent No.: US 8,047,817 B2
(45) Date of Patent: Nov. 1, 2011

(54) CLEANING METHOD OF A ROTARY PISTON VACUUM PUMP

(75) Inventors: David Paul Manson, Newhaven (GB); Kristian Laskey, London (GB)

(73) Assignee: Edwards Limited, Crawley, West Sussex (GB)

( * ) Notice: Subject to any disclaimer, the term of this patent is extended or adjusted under 35 U.S.C. 154(b) by 1148 days.

(21) Appl. No.: 10/573,682

(22) PCT Filed: Sep. 20, 2004

(86) PCT No.: PCT/GB2004/004009

§ 371 (c)(1),
(2), (4) Date: Sep. 18, 2006

(87) PCT Pub. No.: WO2005/028871

PCT Pub. Date: Mar. 31, 2005

(65) Prior Publication Data

US 2007/0172361 A1 Jul. 26, 2007

(30) Foreign Application Priority Data

Sep. 23, 2003 (GB) ..... 0322238.7
Apr. 29, 2004 (GB) ..... 0409568.3

(51) Int. Cl.
*F04B 53/00* (2006.01)

(52) U.S. Cl. ..... 417/431

(58) Field of Classification Search ..... 417/431, 417/53, 430

See application file for complete search history.

(56) References Cited

U.S. PATENT DOCUMENTS 4,995,794 A * 2/1991 Wycliffe ..... 417/431
5,356,275 A * 10/1994 Brenner et al. ..... 418/9
5,443,644 A 8/1995 Ozawa
5,718,565 A * 2/1998 Kuhn et al. ..... 417/44.3
5,975,857 A * 11/1999 Kuhn et al. ..... 417/53

(Continued)

FOREIGN PATENT DOCUMENTS

EP 0 320 956 B1 6/1989

(Continued)

OTHER PUBLICATIONS

Wakabayashi Mitsuo; Patent Abstracts of Japan; abstract of JP 06342785, "Exhauster of Vapor Growth Device and Cleaning Method Thereof," Dec. 13, 1994; Fujitsu Ltd.

(Continued)

*Primary Examiner* — Devon C Kramer
*Assistant Examiner* — Bryan Lettman

(57) ABSTRACT

A method for managing deposits within a pump mechanism (81) is provided. Fluid suitable for dissolving, diluting or otherwise disengaging deposits which have accumulated on the internal working surfaces of the pump is brought into contact with the mechanism. The performance of the pump is monitored and this data is used together with process data received from, or associated with, a tool (83) being evacuated by the pump to calculate (80) fluid flow characteristics which are required to compensate for the accumulation of deposits on the internal working surfaces of the pump. Fluid is then introduced (2, 84) into the pumping mechanism in accordance with the calculated fluid flow characteristics.

20 Claims, 6 Drawing Sheets

U.S. PATENT DOCUMENTS

| | | | | |
|---|---|---|---|---|
| 6,155,502 | A | 12/2000 | Liou et al. | |
| 6,189,176 | B1 * | 2/2001 | Ivey et al. | 15/304 |
| 6,224,326 | B1 * | 5/2001 | Puech | 415/90 |
| 6,316,045 | B1 * | 11/2001 | Bernard et al. | 427/8 |
| 7,819,646 | B2 * | 10/2010 | Hope et al. | 418/201.1 |
| 2002/0034880 | A1 | 3/2002 | Sakai et al. | |
| 2002/0141882 | A1 | 10/2002 | Ingistov et al. | |

FOREIGN PATENT DOCUMENTS

| | | | |
|---|---|---|---|
| GB | 2 017 213 | A | 10/1979 |
| WO | WO 2004/005720 | A1 | 1/2004 |
| WO | WO 2004/036047 | A1 | 4/2004 |

OTHER PUBLICATIONS

United Kingdom Search Report of Application No. GB 0409568.3; Date of search: Aug. 25, 2004.

PCT International Search Report of International Application No. PCT/GB2004/004009; Date of mailing of the International Search Report: Dec. 17, 2004.

PCT Written Opinion of the International Searching Authority of International Application No. PCT/GB2004/004009; Date of mailing: Dec. 17, 2004.

* cited by examiner

CLEANING METHOD OF A ROTARY PISTON VACUUM PUMP

FIELD OF THE INVENTION

This invention relates to the field of vacuum pumps. In particular, but not strictly limited to vacuum pumps with a screw type configuration.

BACKGROUND OF THE INVENTION

Screw pumps usually comprise two spaced parallel shafts each carrying externally threaded rotors, the shafts being mounted in a pump housing such that the threads of the rotors intermesh. Close tolerances between the rotor threads at the points of intermeshing and with the internal surface of the pump body, which typically acts as a stator, causes volumes of gas being pumped between an inlet and an outlet to be trapped between the threads of the rotors and the internal surface and thereby urged through the pump as the rotors rotate.

Screw pumps are widely regarded as a reliable means for generating vacuum conditions in a multitude of processes. Consequently, they are being applied to an increasing number of industrial processes. Such applications may involve materials that have "waxy" or "fatty" properties e.g. tallow based plasticisers. In operation of the pump, these products form deposits on the surfaces of the pump. On shutdown of the pump these surfaces cool, the deposits also cool and solidify within the pump. Where such deposits are located in clearance regions between components, they can cause the pump to seize up such that restart is inhibited or even prevented.

Similar problems can be encountered in a number of semiconductor processes that use vacuum pumps, especially those in the chemical vapour deposition (CVD) category. Such processes can produce a significant amount of by-product material. This can be in the form of powder or dust, which may remain loose or become compacted, or in the form of hard solids, especially if the process gas is condensable and sublimes on lower temperature surfaces. This material can be formed in the process chamber, in the foreline between the chamber and the pump, and/or in the vacuum pump itself. If such material accumulates on the internal surfaces of the pump during its operation, this can effectively fill the vacant running clearance between the rotor and stator elements on the pump, and can also cause spikes in the current demand on the motor of the vacuum pump. If this continues unabated, then this build-up of solid material can eventually cause the motor to become overloaded, and thus cause the control system to shut down the vacuum pump. Should the pump be allowed to cool down to ambient temperature, then this accumulated material will become compressed between the rotor and stator elements. Due to the relatively large surface area of potential contact that this creates between the rotor and stator elements, such compression of by-product material can increase the frictional forces opposing rotation by an order of magnitude such that rotation is prevented on restart.

In order to release the rotors in prior art pumps, a facility is provided whereby a bar can be inserted into sockets attached to the primary shaft of the rotor through an access panel. This bar is used as a lever to try to rotate the shaft and release the mechanism such that the machine can be restarted. This levering system allows more rotational force to be applied to the internal components than could be exerted by the motor. Such force will be transmitted to the rotor vanes and the associated stresses may prove to be detrimental to the structure of the rotor. If this system fails to release the mechanism it is then necessary to disassemble the apparatus such that a liquid solvent can be poured into the pump casing to dissolve the residue to a level where the shaft can be rotated manually. This disassembly not only causes the pump to be off line for a certain length of time, but it then must be re-commissioned and re-tested to ensure the reliability of the connections to the surrounding apparatus.

Our pending international application WO2004/036047 describes how the delivery of a cleaning fluid can be activated at predetermined intervals during operation of the pump, for example using solenoid valve control. The performance of the pump is monitored by measuring at least one of the group of rotor speed, power consumption and volumetric gas flow rate. These measured parameters are subsequently used to determine the extent of accumulation of deposits on the internal working surfaces of the pump. A cleaning fluid flow rate is then calculated, this rate being that of the delivered fluid that would be sufficient to compensate for the quantity of accumulated deposits. In this way the flow rate of cleaning fluid being delivered to the rotor can be continuously adjusted to reflect the new calculated value.

It is an aim of the present invention to seek to further improve the aforementioned process.

BRIEF SUMMARY OF THE INVENTION

According to the present invention there is provided a method for managing deposits within a pump mechanism by introducing fluid suitable for dissolving, diluting or otherwise disengaging deposits which have accumulated on the internal working surfaces of the pump, the method comprising the steps of:

(a) monitoring the performance of the pump, for example, by recording at least one of the group of pressure at the exhaust of the pump and motor current;
(b) receiving process data from, or associated with, a tool being evacuated by the pump;
(c) calculating fluid flow characteristics required to compensate for the accumulation of deposits on the internal working surfaces of the pump based on the monitored performance and the process data; and
(d) introducing fluid into the pumping mechanism in accordance with the calculated characteristics.

Where the deposits are in solid form, the fluid may typically be a halogen, such as a fluorinated liquid or gas. Alternatively, especially where the deposits are formed of powder, the fluid may be an inert purge gas, such as Nitrogen, in particular this may be delivered at an elevated pressure, for example in excess of 2000 mbar.

Where the fluid is a halogen, a second fluid may also be introduced to the pump, this second fluid being inert purge gas. The two fluids may be introduced at different locations in the pump in order to achieve localised effects. For example, the first fluid may be aimed directly at the internal working surfaces of the pump to focus the fluid into the regions of accumulated deposits. Furthermore, the second fluid (typically an inert purge gas) may simultaneously be directed towards sealing components of the pump such that they are protected from the corrosive effects of the halogen fluid.

Where a second fluid is used, it may be introduced after injection of the first fluid has terminated in order to flush the corrosive halogen material and any dislodged deposits out of the pump, thus minimising exposure time of the internal surfaces of the pump to the corrosive materials. In this way corrosion of the pump components is minimised.

The fluid flow characteristics may be at least one of the group of flow rate, temperature, pressure and duration of injection.

The fluid may be introduced during normal operation of the pump, where the fluid is a high pressure purge gas it may be introduced into an exhaust section of the pump if there is a process occurring. Alternatively, the fluid may be introduced when the pump is off line and there is no current process running, in this embodiment the foreline valve between the process chamber and the vacuum pump may be closed to prevent fluid from the pump migrating back to the process chamber.

According to another embodiment of the present invention there is provided a pumping arrangement comprising a vacuum pump having a rotor element and a stator element, at least one fluid port, means for monitoring the performance of the pump, means for receiving process data from, or associated with, a tool being evacuated by the pump, means for calculating fluid flow characteristics required to compensate for the accumulation of deposits on the internal working surfaces of the pump based on the monitored performance and the process data, and means for introducing into the pump via said at least one port and in accordance with the calculated characteristics, fluid for acting on deposits located on the element surfaces to enable said deposits to be removed therefrom.

The controller of the dry pump apparatus may comprise a microprocessor which may be embodied in a computer, which in turn is optionally programmed by computer software which, when installed on the computer, causes it to perform the method steps (a) to (d) mentioned above. The carrier medium of this program may be selected from but is not strictly limited to a floppy disk, a CD, a mini-disc or digital tape.

BRIEF DESCRIPTION OF THE DRAWINGS

An example of the present invention will now be described with reference to the accompanying drawings in which.

DETAILED DESCRIPTION OF THE INVENTION

Figure 1:
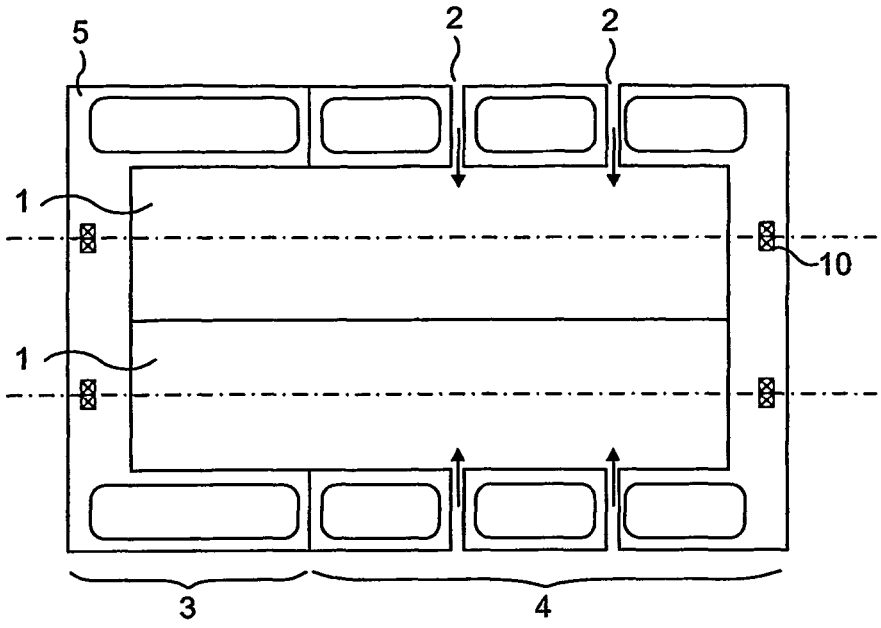
FIG. 1 illustrates a schematic of a screw pump.
Figure 2:
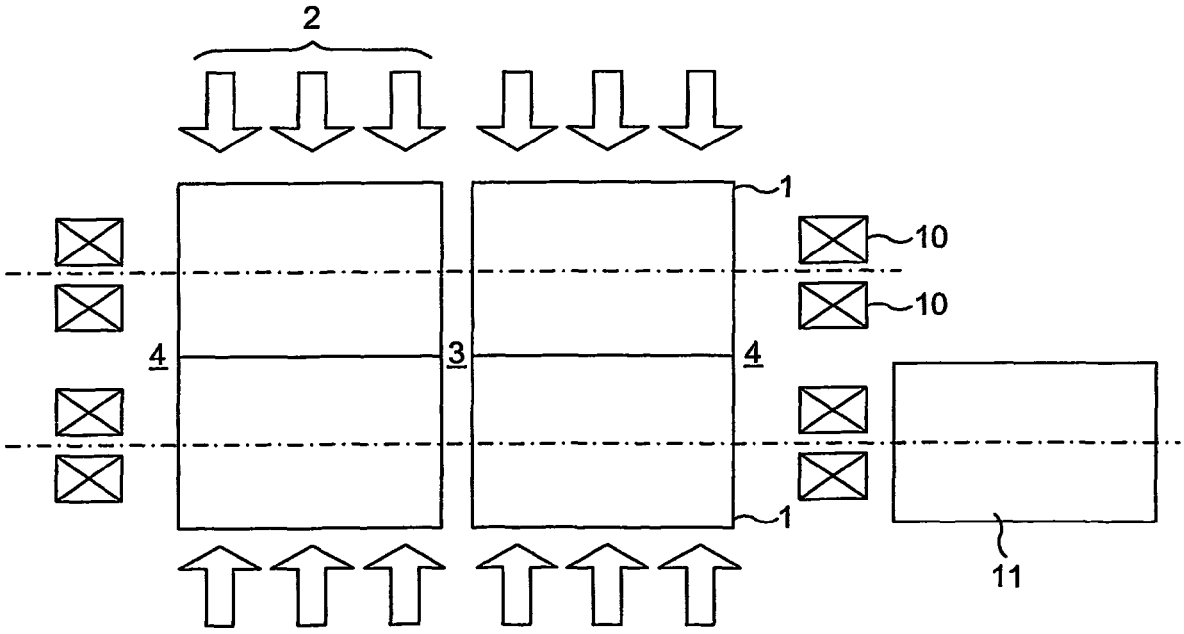
FIG. 2 illustrates a schematic of a double-ended screw pump.

Whilst the example pumps illustrated in FIGS. 1 and 2 are screw pumps it is envisaged that this invention can be applied to any type of vacuum pump, in particular claw pumps.

Figure 3:
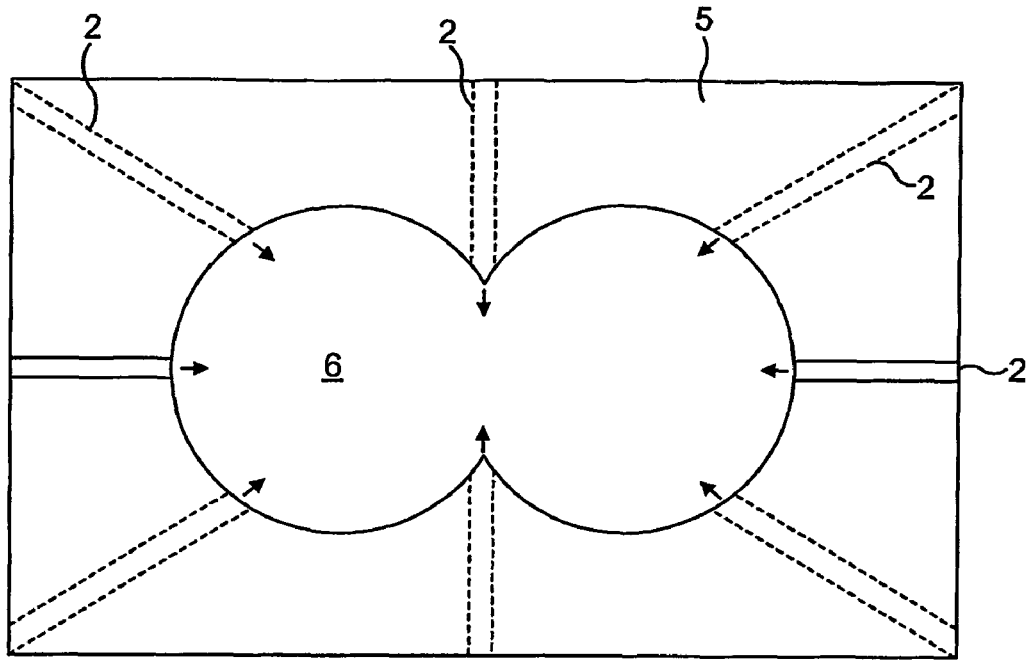
FIG. 3 is an end sectional view of the pump of FIGS. 1 and 2.

In the example of FIG. 1, two rotors 1 are provided within an outer housing 5 that serves as the stator of the pump. The two contra-rotating, intermeshing rotors 1 are positioned such that their central axes lie parallel to one another. The rotors are mounted through bearings 10 and driven by a motor 11 (shown in FIG. 2). Injection ports 2 are provided along the length of the rotor, in the examples of FIGS. 1 and 2 (shown as solid lines in FIG. 3) these ports 2 are located laterally within the pump on the opposite side of the rotors from the intermeshing region of the rotors. However, the ports may be positioned at any radial location around the stator 5. Some of these locations are illustrated as dashed lines in FIG. 3.

The ports 2, which may contain nozzles (not illustrated) to allow the fluid to be sprayed, are preferably distributed along the length of the stator component 5 such that the solvent or steam can be easily applied over the entire rotor 1. Alternatively, this distribution of ports 2 allows the fluid to be readily concentrated in any particular problem area that may arise. This is especially important when solvent is injected during operation, in order to limit the impact on pump performance. If, for example, a single port was to be used at the inlet 3 of the pump, this may have a detrimental effect on the capacity of by-products that could be transported away from the evacuated chamber (not shown) by the pump. By bringing solvent into contact with the rotor 1 after the first few turns of the thread of the rotor 1, the likelihood of backward contamination of the solvent into the chamber will be reduced.

Furthermore, where solvent is introduced in the inlet region 3 of the pump, the pressure is such at the inlet that there is an increased risk that the solvent will flash. In processes where it is necessary for the solvent to remain in liquid phase the solvent must be introduced closer towards the exhaust region of the pump where the pressures will have risen. As solvent is introduced through a number of ports 2 along the length of the stator 5, the overall effect is to gradually increase the quantity of solvent present, as the likelihood of residue build up on the rotor 1 increases towards the exhaust stages. An additional benefit may be seen in some configurations where addition of liquid into the final turns of thread of the rotor 1 will act to seal the clearances between the rotor 1 and the stator 5 in this region of the pump. Thus leakage of gas will be substantially reduced and performance of the pump will be improved.

In some processes, it is not appropriate to introduce solvent during operation as the waste products from the evacuated chamber are collected at the outlet 4 of the pump for a particular purpose and this material ought not to be contaminated. Other applications may not result in levels of residue that warrant constant injection of solvent during operation. In these cases, and where an unplanned shut down of the pump occurs such that standard practices, such as purging, are not followed, the residue from the process cools down as the apparatus drops in temperature. In these circumstances a seizure of the mechanism may occur as deposits build up and become more viscous or solidify. In a system according to the present invention, the injection ports 2 can be used to introduce a solvent into the stator cavity 6 in a distributed manner without needing to go to the expense or inconvenience of disassembling the apparatus. Once the solvent has acted upon the deposits to either soften or dissolve them, the shaft may then be rotated either by using the motor or manually to release the components without applying excessive, potentially damaging, force to the rotor 1.

Figure 5:
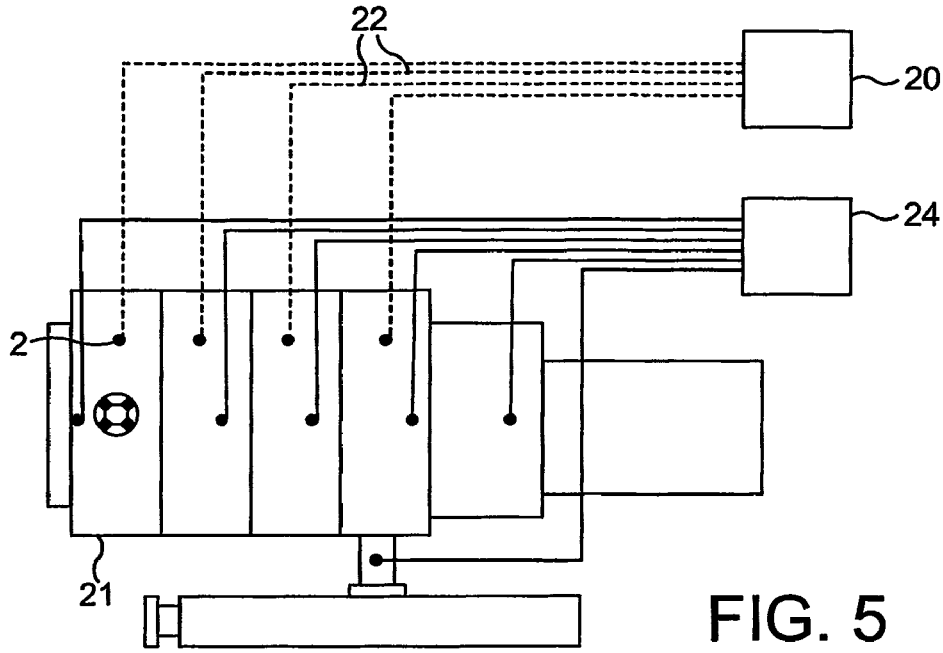
FIG. 5 illustrates an arrangement for supplying fluid to a pump.

Delivery of fluid may be performed through simple ports 2 as liquid is drip-fed through a hole in the housing or nozzles may be provided through which the fluid may be sprayed. Control systems may be introduced such that the solvent delivery can be performed in reaction to the changing conditions being experienced within the confines of the pump apparatus. For example, in the arrangement shown in FIG. 5, a control system 20 supplies cleaning fluid, for example, stage by stage, to the ports 2 of pump 21 via supply conduits 22.

As indicated at 24, a purge gas system may also be provided for supplying a purge gas, such as nitrogen to the pump 21.

Where the process material is waxy or fatty, compatible solvents will need to be introduced to perform the dilution/cleaning function. Such solvents may be provided in liquid or vapour form. Any compatible, effective cleaning medium may be used such as xylene in the case of hydrocarbon based/soluble products or water in the case of aqueous based/soluble products, alternatively, detergents may be used.

Where the process material is a by-product of a CVD process, the cleaning fluid may comprise a fluorinated gas. Examples of such cleaning fluid include, but are not restricted to, $ClF_3$, $F_2$, and $NF_3$. The high reactivity of fluorine means that such gases would react with the solid by-products on the pump mechanism, in order to allow the by-products to be subsequently flushed from the pump with the exhausted gases. To avoid corrosion of internal components of the pump by the fluorinated gases, materials need to be carefully selected for use in forming components of the pump, such as the rotor 1 and stator 5 elements, and any elastomeric seals, which would come into contact with the cleaning gas.

Figure 4:
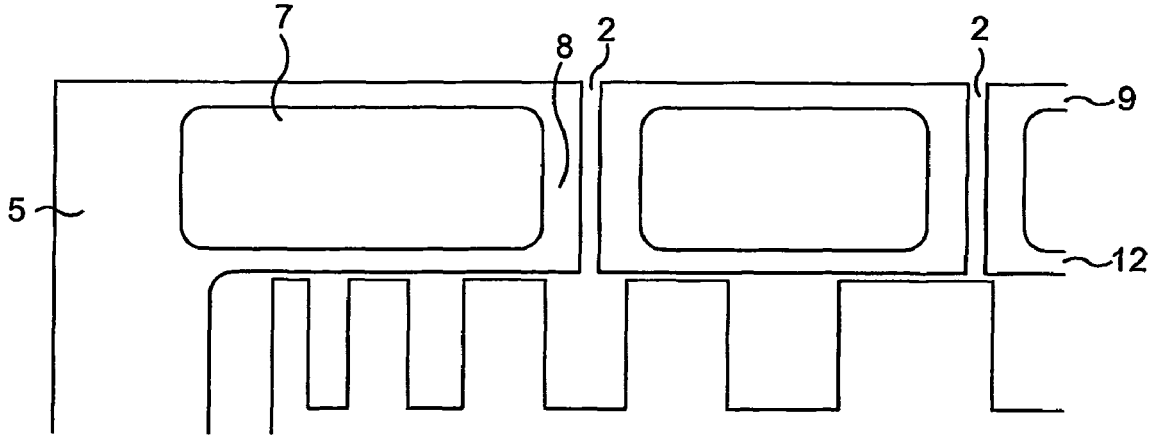
FIG. 4 is a detailed view of a section of a water jacket that illustrates the implementation of an injection port.

The housing 5 as illustrated in FIG. 4 is provided as a two-layer skin construction, an inner layer 12 and an outer layer 9. It is the inner layer 12 that acts as the stator of the pump. A cavity 7 is provided between the layers 12, 9 of the housing 5 such that a cooling fluid, such as water, can be circulated around the stator in order to conduct heat away from the working section of the pump. This cavity 7 is provided over the entire length of the rotor i.e. over the inlet region 3 as well as the exhaust region 4. Under circumstances where the pump has become seized due to cooling of the rotor which, in turn, solidifies residues on the surfaces between the rotor and the stator, the 'cooling liquid' in the cavity 7 of the housing 5 may be heated to raise the temperature of the rotor 1. This can enhance the pliability of the residue and may assist in releasing the mechanism. The housing 5 is provided with pillars 8 of solid material through the cavity 7 in order to provide regions where injection ports 2 can be formed.

Figure 6:
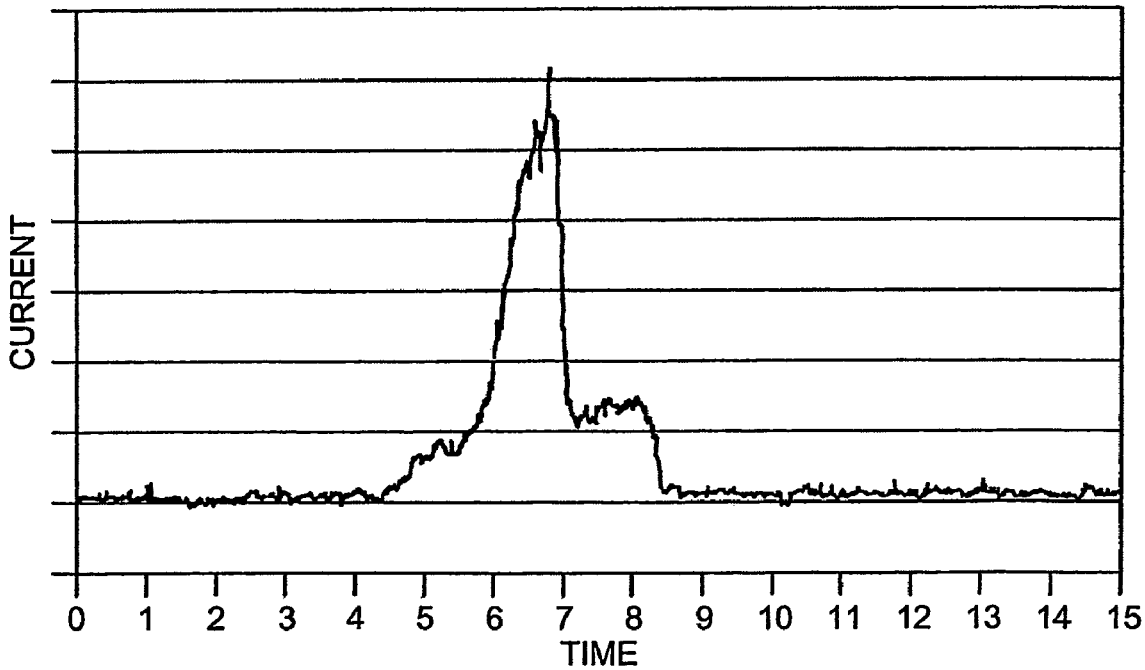
FIG. 6 illustrates a graph of motor current against time from a motor of a vacuum pump experiencing accumulation of deposits.

FIG. 6 illustrates an example transient trace of motor current plotted against time. The data is taken over a period when the pump experiences build up of deposits on its internal working surfaces. The amplitude and frequency of the spikes shown in such a graph are indicative of the extent of the residue formed on the internal surfaces of the pump. However, this indication can be distorted by the process conditions at that particular time and the status of the pump. In order to get a true indication of the level of residue formed within the pump, it is necessary to take the particular process and pump conditions into account. Example conditions that will have an effect on the conditions of the pump and consequently on the monitored parameters are roughing and cleaning the process chamber.

Figure 7:
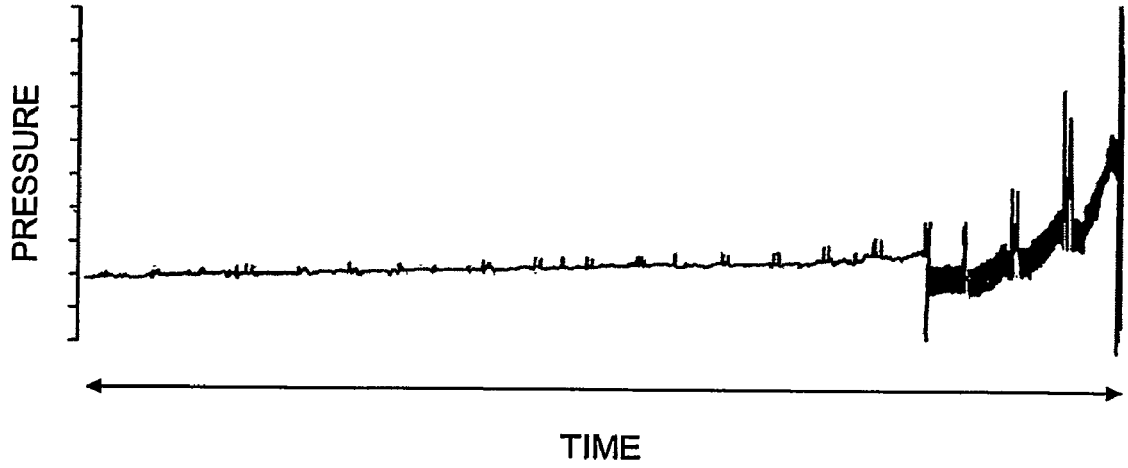
FIG. 7 illustrates a graph of pressure against time taken at the exhaust of a vacuum pump experiencing accumulation of deposits.

Similarly, FIG. 7 illustrates a trace of pressure against time as recorded in the exhaust section of the pump during a period where a build up of particulate matter is occurring within the pump. The exhaust pressure reacts to an increase in pressure in the pump exhaust pipe. This may be used as a means of assessing exhaust deposition and blockage. This, in turn, may be used to determine when and how fluid should be introduced into the pump to clear out any deposits formed therein. The type of fluid to be used is chosen depending upon the process/application being undertaken and whether any deposits are likely to be solid or powder. Once again, it is beneficial to couple this data with process data from, or associated with, the tool in order to eliminate false suggestions of accumulated deposits.

Figure 11:
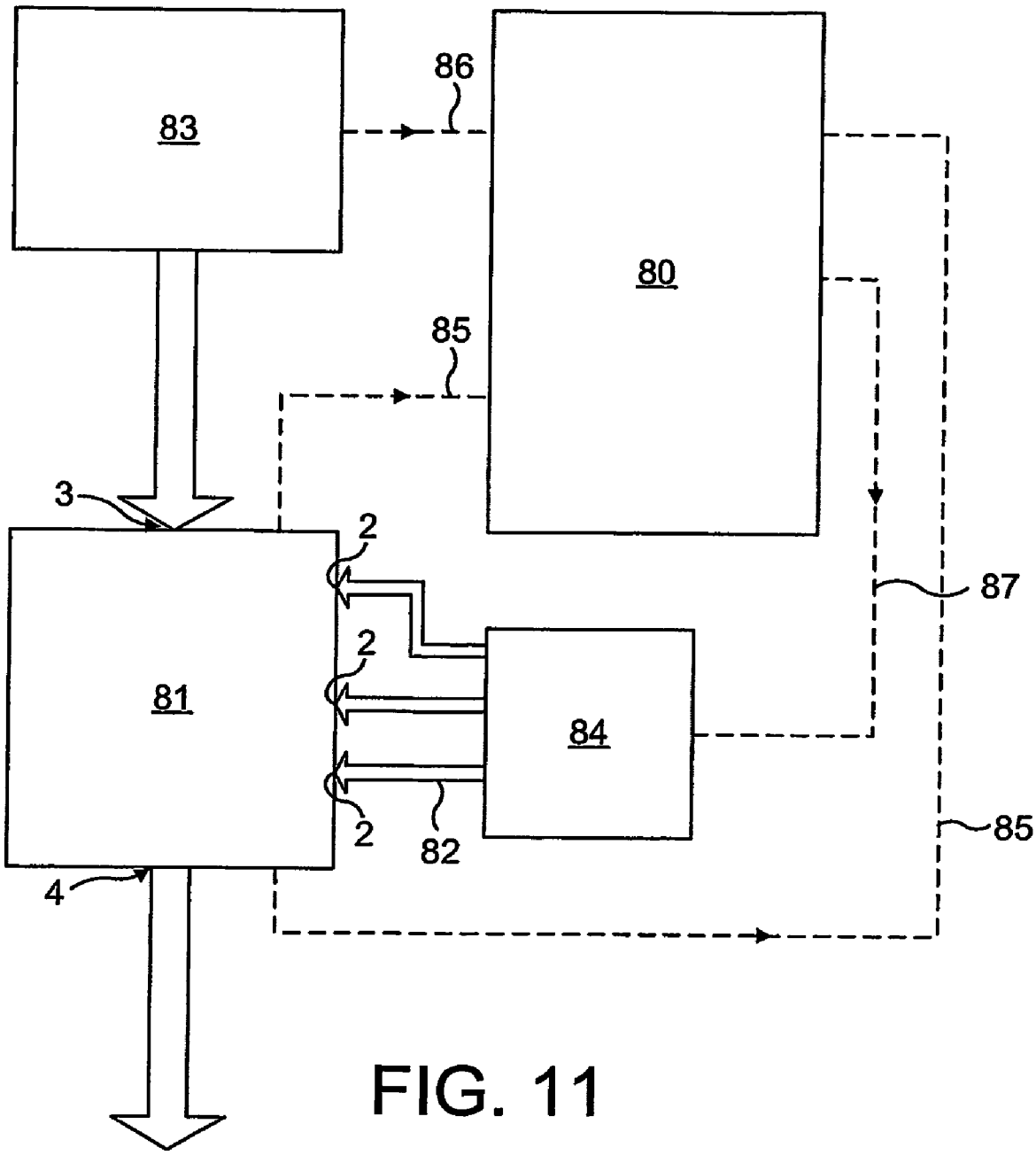
FIG. 11 illustrates a generic pumping arrangement as further detailed in FIGS. 8 to 10.

FIG. 11 illustrates a general pumping arrangement. A pump 81 is provided down stream of a chamber to be evacuated. This chamber forms part of a tool 83, for example, for manufacturing semiconductor wafers or flat panel displays and the like. The chamber is in fluid communication with an inlet 3 of the pump 81. Ports 2 are provided at different locations along the length of the pump 81. These ports are connected, via conduits 82, to a fluid delivery system 84 which may be configured to deliver inert purge gas, or a cleaning fluid, or both, as will be described in more detail below.

Data from the tool 83 is typically provided to a controller 80 along communication line 86 extending between the tool and the controller. This data typically relates to the process being carried out within the tool 83. Examples of such data are which materials are being delivered to the tool at any particular time, the rate of delivery of these materials to the chamber, the status of the tool and the pressure or temperature within the process chamber. Further data, indicative of the environment within the pump 81, is provided to the controller 80 along communication lines 85. This pump environment data may include pressure, temperature or gas flow rate within the pump or in the exhaust region of the pump, power requirements of the pump or vibrations generated by the pump. The data provided to the controller 80 is then used to determine the type, quantity and duration of fluid that is to be delivered from the fluid delivery system 84 to the pump 81 via conduits 82 and ports 2. A signal is then provided by the controller 80 to the fluid delivery system 84 along communication line 87.

Figure 8:
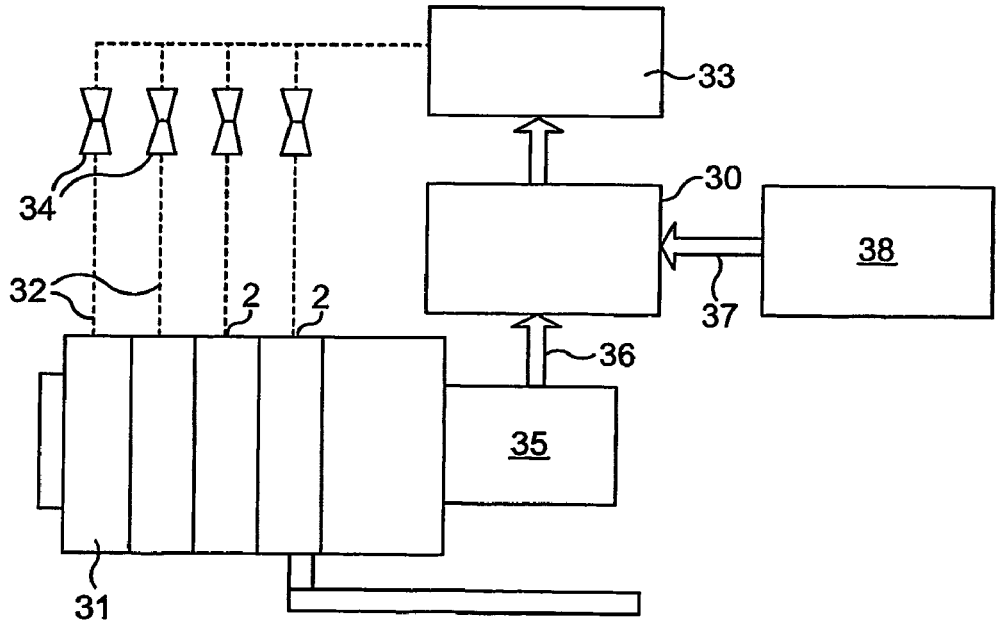
FIG. 8 illustrates a pumping arrangement according to one embodiment of the present invention.

FIG. 8 illustrates one embodiment, where the data indicative of the environment of the pump is data relating to the motor current. This data is supplied to a controller 30 together with data from a process tool 38. Pump 31 is driven by motor 35. Several ports 2 are provided at different locations along the pump as shown in earlier figures. These ports are fed by supply conduits 32 from gas supply 33 via valves 34. The controller 30 is provided with a signal 36 that is indicative of the motor current and a signal 37 which is indicative of the process data. The controller 30 uses this data in combination to determine whether fluorinated gas should be supplied to the pump 31 via ports 2 to counteract the formation of accumulated deposits. This fluorinated gas may be supplied from a fluorine generator or it may be extracted from a gas stream such as $NF_3$, $C_2F_6$, $SF_6$ or similar using a plasma generator such as MKS Astron to produce fluorine radicals. Alternatively, as illustrated here, the fluorine may simply be delivered from a gas storage vessel 33.

Typically the array of valves 34 are sequenced by the controller 30 to effect exposure of relevant sections of the pump 31 to the fluorine gas as required in response to the motor current and process data supplied. It is not only the timing but also the duration and magnitude of each fluorine injection that is governed by the combination of the motor current and process data supplied to the controller 30.

Figure 9:
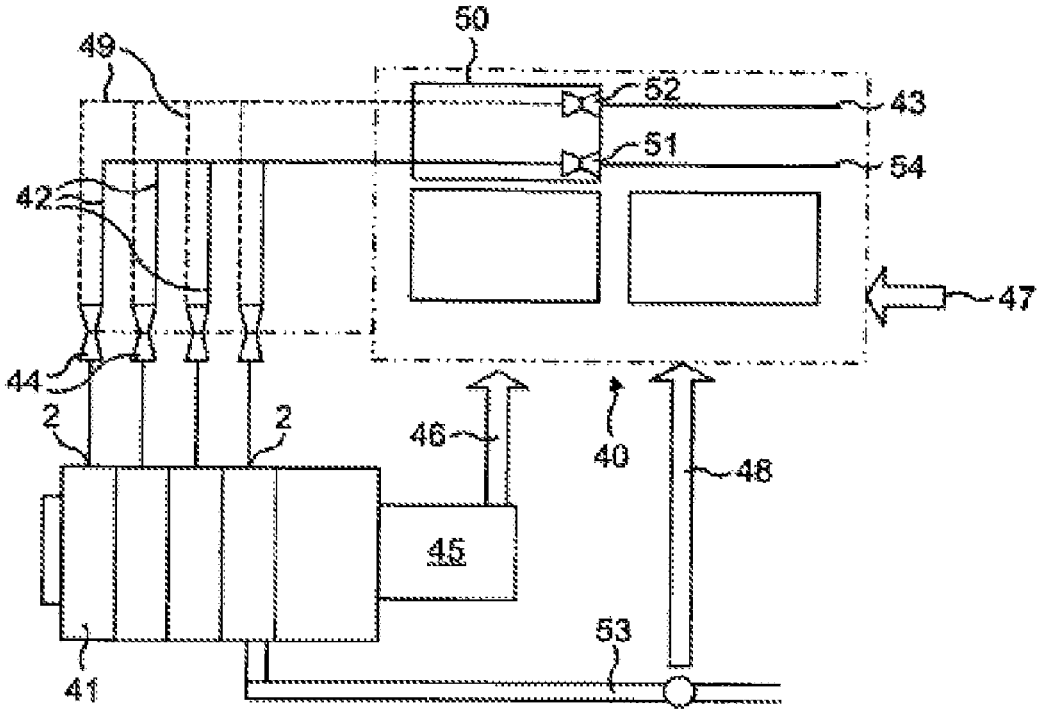
FIG. 9 illustrates a pumping arrangement according to a second embodiment of the present invention.

FIG. 9 illustrates a more complex embodiment. The vacuum pump 41 is driven by motor 45. Once again, ports 2 are provided at different locations within the pump, these are connected via supply conduits 42 and 49 to a purge gas module 50. An array of three way valves 44 are provided in the supply conduits to enable either or neither of the two gases supplied through the conduits 42 and 49 to reach the ports 2. The purge gas module 50, typically (as illustrated here) has two inlet connections 51, 52, one for each type of gas. Controller 40 is provided to receive data from three sources in this example. As in the previous embodiment a signal 46 indicative of the motor current is provided, but in addition a further signal 48, indicative of the pressure in the exhaust section 53 of the vacuum pump 41, is provided. This data is used by the controller 40, as described above, in combination with the process data 47 to determine whether fluorinated gas or inert purge gas (such as Nitrogen) or, indeed both gases, should be introduced into the pump 41.

The controller 40 of the module 50 switches between the two gas supplies 43 and 54 through inlet connections 51 and 52. Typically, each of the valves 44 can be supplied with either gas. As each valve 44 connects to a different port 2 within the pump 41 it is possible to supply different gasses to different locations. This is particularly useful where it is desirable to focus the corrosive fluorinated gas at particular areas whilst protecting other areas such as sealing regions of the pump 41, which may be more sensitive to damage by these corrosive materials. In such a case, the sealing regions of the pump 41, may be flushed with inert purge gas at the same time as the regions experiencing accumulation of deposits (typically the active surfaces of the pump) can be flushed with the fluorinated gas.

Alternatively, each of the ports 2 can be configured to inject the corrosive gas onto the internal surfaces of the pump 41 for a particular duration, this can then be followed by a period where the pump 41 is flushed through with inert purge gas. In this way the corrosive material does not linger within the pump 41 and, therefore, damage is less likely to be caused to the internal components.

Furthermore, gas flow measurement devices can be incorporated into this example to confirm that the expected flow rates of either gas are achieved at particular locations in the pump. This leads not only to optimisation of utility gases and hence a reduction in the cost of operation/ownership but also to a reduction in corrosion and therefore improvements in reliability/longevity of pump.

Figure 10:
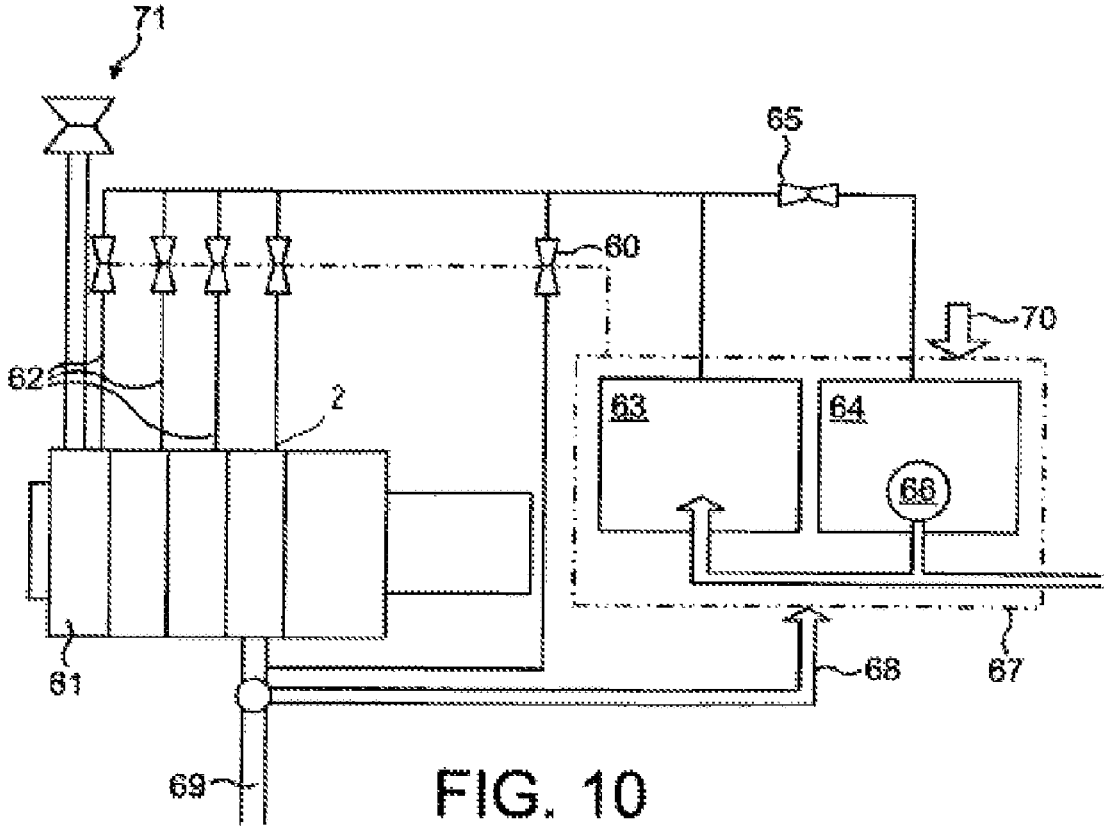
FIG. 10 illustrates a pumping arrangement according to a third embodiment of the present invention.

FIG. 10 illustrates an embodiment to be used in scenarios where the deposition is in the form of powdery residue. Such residue can be dislodged by blasting the affected regions with high pressure turbulent purge gas. In conventional systems, high pressure purge gas is typically avoided due to the significant volumes of gas that need to be used, such usage can become very expensive. By implementing the aforementioned method, it is possible to optimise the quantity of purge gas used to allow it to be just sufficient to dislodge the actual deposits that have formed within the pump.

In this embodiment, vacuum pump 61 is provided with ports 2 which are connected via supply conduits 62 and valves 60 to a purge gas supply. Here, two gas modules are provided, standard purge gas module 63 provides regular purge gas at standard purge pressures, the second gas module is a turbulent purge gas module 64. The turbulent purge gas module 64 comprises a high pressure regulator 66 which enables purge gas to be supplied to the pump, controlled via valve 65, in excess of 2 bar. The supply of this high pressure purge gas is governed by controller 67 which is provided with a signal 68 indicative of the pressure in the exhaust section 69 of pump 61 together with a process data signal 70.

In particular, not only can the volume of gas be determined with accuracy by the controller 67 but the gas can be injected only locally to the problem region. Where the deposits are formed in the exhaust section 69 of the pump 61 it is possible to use this embodiment of the invention during normal operation of the pump, however, where the deposits are not so remote from the inlet it is necessary to flush the pump 61 when it is off-process and the valve 71 in the foreline between the process chamber and the pump 61 is shut. In this embodiment the controller 67 also receives data regarding the status of the foreline valve 71 such that it prevents activation of the high pressure purge upstream of the exhaust section 69 when the pump 61 is on line The turbulent purge gas module 64 may be provided as an integral part of the standard gas module 63 for the pump 61 or it may be provided separately to it. A valve 65 is provided between the standard gas purge system 63 and the high pressure regulator 66 in order to allow high pressure gas to enter the system when necessary.

The controller in each embodiment allows for different modes of operation depending on the analysis of the condition of the pump. Taking motor current data as an example, where no current spikes are detected, "normal operation" ensues, and there is no need for any gas to be injected into the pump. Where some spikes are detected, a "preventative mode" may be used where there is potential benefit in providing small quantities of fluorinated gas or high pressure purge gas to the surfaces of the pump at predetermined intervals. "Active operation" suggests that the monitoring means is detecting numerous spikes which are not due to the process or pumping conditions, indicating that significant levels of deposition are frequently occurring within the pump. Here it is highly beneficial to actively use the aforementioned method to inhibit build up of these deposits. Where it is noted by the monitoring means that the level of spikes is increasing even with active use of this method, the pump has entered a "service required" mode where further intervention is required at the next opportunity such that any product within the process chamber is not in jeopardy.

The present invention is not restricted for use in screw pumps and may readily be applied to other types of pump such as Northey ("claw") pumps or Roots pumps.

It is to be understood that the foregoing represents just a few embodiments of the invention, others of which will no doubt occur to the skilled addressee without departing from the true scope of the invention as defined by the claims appended hereto.

We claim:

1. A method for managing deposits within a pump by introducing a fluid suitable for dissolving, diluting or otherwise disengaging deposits which have accumulated on internal working surfaces of the pump, the method comprising the steps of:

(a) monitoring the performance of the pump;

(b) receiving process data from, or directly associated with, a tool being evacuated by the pump, wherein the tool is configured to receive various gas streams for performing a chemical reaction to produce a predetermined material;

(c) calculating fluid flow characteristics required to compensate for accumulation of deposits on the internal working surfaces of the pump caused by exhaust gases evacuated from the tool by the pump, based on the monitored performance of the pump and the process data of the tool; and (d) introducing fluid into the pump at a localized area via a predetermined port selected from a plurality of ports within the pump in accordance with the calculated fluid flow characteristics, thereby avoiding a backward contamination of the tool by the fluid.

2. The method according to claim 1 wherein the fluid comprises a halogen.

3. The method according to claim 2 wherein the fluid comprises a fluorinated liquid or gas.

4. The method according to claim 1 wherein the fluid comprises an inert purge gas.

5. The method according to claim 4 wherein the inert purge gas is delivered at an elevated pressure.

6. The method according to claim 5 wherein the inert purge gas is delivered at a pressure in excess of 2000 mbar.

7. The method according to claim 2 wherein the fluid comprises a first and a second fluid introduced to the pump, the second fluid being an inert purge gas.

8. The method according to claim 7 wherein the first and second fluids are introduced at different locations in the pump.

9. The method according to claim 8 wherein the first fluid is directed to the internal working surfaces of the pump.

10. The method according to claim 8 wherein the second fluid is directed towards sealing components of the pump.

11. The method according to claim 7 wherein the second fluid is introduced after injection of the first fluid has terminated.

12. The method according to claim 1 wherein the fluid flow characteristics are selected from a group of flow characteristics consisting of flow rate, temperature, pressure and duration of injection.

13. The method according to claim 1 wherein the fluid is introduced during normal operation of the pump.

14. The method according to claim 13 wherein the fluid is introduced into an exhaust section of the pump.

15. The method according to claim 1 wherein the fluid is introduced when the pump is off line.

16. The method according to claim 1 wherein the monitoring step comprises recording a pressure at the exhaust of the pump.

17. The method according to claim 3 wherein a second fluid comprising an inert purge gas is introduced to the pump.

18. The method according to claim 9 wherein the second fluid is directed towards sealing components of the pump.

19. The method according to claim 1 wherein the monitoring step comprises recording motor current of the pump.

20. A pumping arrangement comprising:

a vacuum pump having a rotor element and a stator element, and at least one fluid port;

means for monitoring the performance of the vacuum pump;

means for receiving process data directly from a tool adapted to be evacuated by the vacuum pump, wherein the tool is configured to receive various gas streams for performing a chemical reaction to produce a predetermined material;

means for calculating fluid flow characteristics required to compensate for accumulation of deposits on internal working surfaces of the vacuum pump caused by exhaust gases evacuated from the tool by the vacuum pump based on the monitored performance of the vacuum pump and the process data of the tool; and means for introducing fluid into the vacuum pump at a localized area via the at least one fluid port selected from a plurality of fluid ports within the pump in accordance with the calculated fluid flow characteristics for acting on deposits located on the internal working surfaces of the vacuum pump to enable the removal of deposits therefrom in a manner that avoids backward contamination of the tool by the fluid.

* * * * *